United States Patent [19]

Milliman et al.

[11] 4,417,513

[45] Nov. 29, 1983

[54] PRINTING APPARATUS AND METHOD

[75] Inventors: Bruce A. Milliman, Big Flats; Harris G. Rodgers, Sr., Corning, both of N.Y.

[73] Assignee: Corning Glass Works, Corning, N.Y.

[21] Appl. No.: 419,471

[22] Filed: Sep. 17, 1982

[51] Int. Cl.[3] ..... B41F 17/00

[52] U.S. Cl. ..... 101/41; 101/151; 101/158; 101/252

[58] Field of Search ..... 101/35, 41, 42, 43, 101/44, 150, 151, 154, 158, 252, 126

[56] References Cited

U.S. PATENT DOCUMENTS

| | | | |
|---|---|---|---|
| 1,261,171 | 4/1918 | Smith | 101/151 |
| 2,411,475 | 11/1946 | Stockman | 101/126 |
| 2,739,529 | 3/1956 | Fernandez | 101/41 X |
| 2,904,916 | 9/1959 | Stahmann | 101/41 X |
| 3,688,695 | 9/1972 | James | 101/44 X |
| 3,742,843 | 7/1973 | Gulikers | 101/41 |
| 3,900,364 | 11/1976 | Paans | 101/44 X |
| 3,916,784 | 11/1975 | Dubuit | 101/151 X |
| 4,098,184 | 7/1978 | Okada et al. | 101/41 |

FOREIGN PATENT DOCUMENTS

| | | | |
|---|---|---|---|
| 461744 | 2/1937 | United Kingdom | 101/151 |
| 980438 | 1/1965 | United Kingdom | 101/252 |
| 1456016 | 11/1976 | United Kingdom | 101/41 |

*Primary Examiner*—Clifford D. Crowder

*Attorney, Agent, or Firm*—J. P. DeLuca; B. R. Turner

[57] ABSTRACT

A printing apparatus including a circular turret for carrying a plurality of flexible membrane collectors thereon. The collectors are hingeably mounted near a peripheral edge of the turret and sequentially engage printing stations for receiving a design portion on one side thereof. The collectors are indexably rotated into a transfer station whereupon they are deployed outboard of the turret. A flexible plunger engages a backside of the collector for stretching the same into engagement with ware for transferring the design from the collector to said ware.

5 Claims, 3 Drawing Figures

C
14
12
22
80
84
19'
83
P
82
81
85
24
15
(3)
18
31
18
(2)
32
30
34
54
52I
77
75
20
70
21
19
74
72
PI
PI'
38
36
40
28
48
44
76
62
64
17
56
(4)
42
46
(1)
PO
PO'
520
58
60
66
16

PRINTING APPARATUS AND METHOD

BACKGROUND

The present invention relates to a printing method and apparatus. More particularly, the invention employs flexible collectors mounted on a turret, multiple print stations, and a print transfer station. Each collector is mounted for deployment between print receiving and print transferring positions.

In conventional printing apparatus, many schemes are employed to produce multi-color designs. The limits of quality and speed vary with the cost of such apparatus. The present invention produces high quality designs at moderate rates.

SUMMARY OF THE INVENTION

A printing apparatus is disclosed which includes a circular turret having a drive for rotatably indexing the turret about its center. Collectors are mounted to the turret at evenly spaced intervals near an outer peripheral edge thereof. Multiple print stations and a single print transfer station are circumferentially located about the periphery of the turret at evenly spaced intervals corresponding to the spacing of the collectors. Each print station produces a portion of the design and deposits the same on each collector in registration with each other design portion. The print transfer station transfers the design to an object by engagement of the same with the collector. Each collector is hinged to the turret for deployment between print receiving and print transferring positions.

DESCRIPTION OF THE PREFERRED EMBODIMENT

Figure 1:
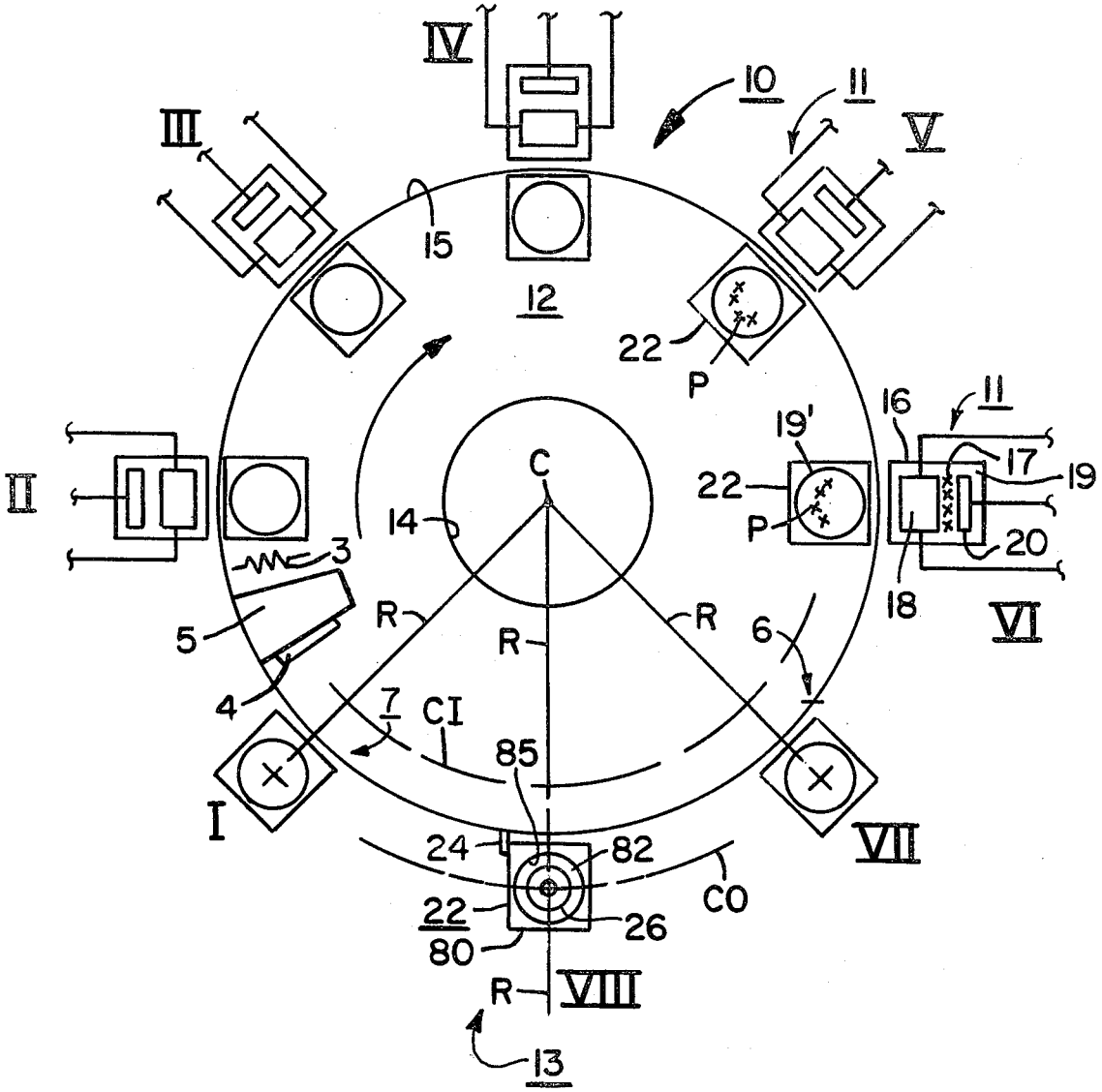
FIG. 1 is a schematic plan view of a printing apparatus of the present invention.

Referring to FIG. 1, there is shown a printing apparatus 10 comprising a turret 12 and drive 14, a plurality of collectors 22, a plurality of print stations 11 at positions II—VI, a print transfer station 13 located at position VIII, and respective tip out and tip in stations 6 and 7 at positions I and VII at either side of print transfer station 13. A cleaning roll 5, having a scraper blade 4, is located between positions I and II for engaging collectors 22 and cleaning the same prior to entry into the first print station 11. The turret 12 is indexably driven clockwise by the drive 14, which may be an INTERMITTER manufactured by Furguson Machine Co. Collectors 22 are hingeably mounted onto the turret 12 at selected evenly spaced positions near a peripheral edge 15 thereof. In the present invention, eight collectors 22 are located at circumferential positions 45° apart. Each collector 22 is mounted to the turret 12 by a hinge 24 and may be deployed between two concentric positions, one inboard and one outboard of the peripheral edge 15 of the turret 12.

When indexed into each print station 11 at positions II through VI, the collectors 22 are deployed inboard of the peripheral edge 15, and are each centered on rays R intersecting a radial position on inboard circle CI. When each collector 22 is indexed into the print transfer station 13 at position VIII, the collector 22 is deployed along ray R and centered on an outboard circle CO. The respective inboard and outboard circles CI and CO are concentric with a center C of the turret 12 and its peripheral edge 15. When the collector 22 is indexed into tip out station 6 at position VII, the collector 22 is moved from its inboard position at CI to its outboard position at CO. Likewise, when the collector 22 is indexed into tip in station 7 at position I it moves from outboard position at CO to inboard position at CI. A collector preheater 3 located before print station 11 at position II may be used to equilibrate the temperature of the collector 22 prior to entry therein.

Each print station 11 deposits a portion P of a design D (see FIG. 3) onto each collector 22 when the same is deployed inboard of the turret 12. After a completed design D has been deposited on collector 22 (see position VI), it is rotated about the hinge 24, at tip out station 6 whereupon the design D faces downwardly. The collector 22 is then indexed into print transfer station 13 where the design D is transferred to ware (not shown).

Each print station 11 includes a heated gravure surface 16, a transfer roll 18, and a doctor assembly 20. A pressure-sensitive thermoplastic hot melt ink 19 of the type described in copending U.S. patent application Ser. No. 419,196 filed this same date, is deposited onto the gravure surface 16. The doctor assembly 20 spreads and doctors the ink 16 into engravings 17 in gravure surface 16. Transfer roll 18 is rolled across the gravure surface 16 and a portion of the ink 19 in the engravings 17 splits between the gravure surface 16 and the transfer roll 18. The ink 19 cools upon contact with the transfer roll 18 and becomes tacky and cohesive. Transfer roll 18, carrying the ink 19, is thereafter rolled against the collector 22, whereupon the ink 19 transfers completely from the transfer roll 18 to the collector 22 as a cohesive tacky film 19', forming a portion P of the design D (see also U.S. patent application Ser. No. 173,129 filed July 28, 1980).

The preferred collector 22 comprises a flexible membrane 82 stretched over a frame 80. The frame 80 has an aperture 85 therein. The print transfer station 13 comprises a flexible plunger 26 which engages the collector 22 on a side opposite the design D to stretch the collector 22 and urge the same against ware as hereinafter described.

The turret 12 is indexably driven by the indexable drive 14 which stops and starts the turret 12 periodically. Each collector 22 stops at each position I through VIII. It should be understood that all print stations 11 may not always be used.

Figure 2:
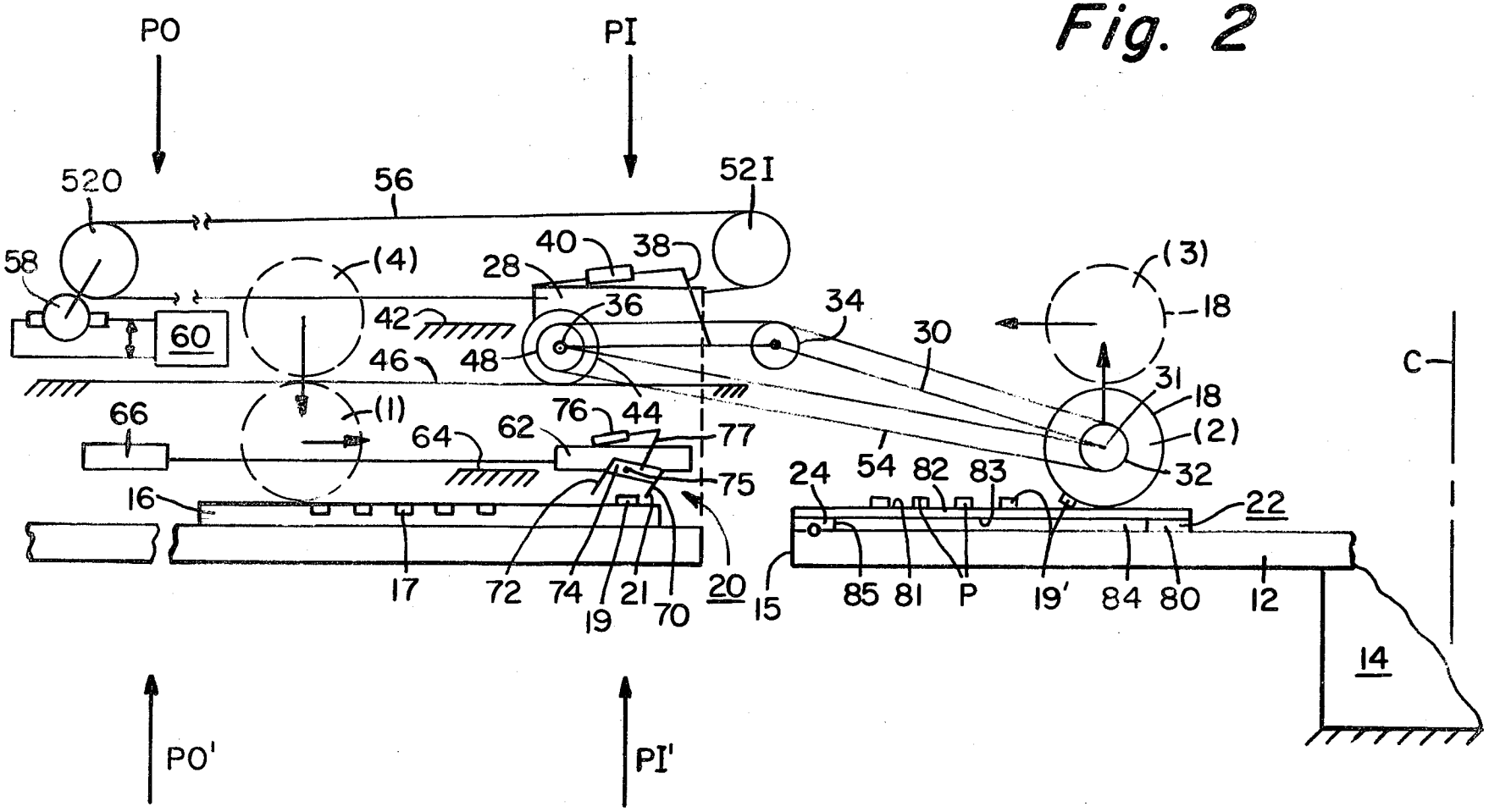
FIG. 2 is a fragmented schematic illustration of a print station incorporating a transfer roll shown in various positions.

Referring to FIG. 2, one print station 11 is shown for depositing a corresponding portion P of the design D onto the collector 22. The print station 11 operates the transfer roll 18 along a programmed path. For example, the transfer roll 18 begins at position (1) (to the left of gravure surface 16). The transfer roll 18 rolls across the gravure surface 16 for picking up the ink 19 from engravings 17 and forming the film 19' as a portion P of the design D. Thereafter, transfer roll 18 continues to roll into engagement with the collector 22 for depositing the film 19' thereon, after which it reaches position (2) (to the right of the collector 22). The transfer roll 18 is lifted to position (3) and thereafter withdrawn back to position (4) directly above position (1) to the left of the gravure surface 16.

Simultaneously with the above described action, the gravure surface 16 receives ink 19 in a metered amount. The ink 19 may be manually deposited in the form of solid meltable bars (not shown) onto heated gravure surface 16, or the ink 19 may be melted and poured thereon. The ink 19 is spread across the gravure surface 16 by means of doctor assembly 20, including a support bar 74 carrying a squeege 70 and doctor blade 72. Support bar 74 is pivoted about an axis 75. The squeege 70 engages the gravure surface 16 in spaced relation for spreading a bead 21 of the ink 19 in the form of a film thereacross in a direction from left to right. When the squeege 70 reaches the extreme right hand end of the gravure surface 16 it is tilted about axis 75, whereupon doctor blade 72 engages the gravure surface 16 and doctors or scrapes the same as the support bar 74 is drawn thereacross to the left of position (1). The doctor blade 72 scrapes the ink 19 from the gravure surface 16 and leaves ink in engravings 17. Thereafter, the transfer roll 18 is moved into position (1) for beginning the next cycle. The squeege 70 and doctor blade 72 are generally in parallel alignment with axis 75.

Transfer roll 18 is carried at an end 31 of an arm 30. The arm 30 is pivotally mounted on a print trolley at support or center of rotation 36. An actuator arm 38, extending from arm 30, is coupled to the print trolley 28 by a pneumatic piston 40. In an extended mode, the pneumatic piston 40 urges the actuator arm 38 clockwise for likewise rotating the arm 30 clockwise and the transfer roll 18 carried thereby downwardly. In a contracted mode, the pneumatic piston 40 draws the actuator arm 38 counterclockwise for rotating the arm 30 counterclockwise and lifting the transfer roll 18 upwardly. The print trolley 28 rides on rails 42 and reciprocates between respective inboard and outboard positions PI and PO.

The print trolley 28 is coupled to a pair of timing belts 56 carried by respective inboard and outboard pulleys 52 I and 52 O. One of the respective inboard and outboard pulleys 52 I and 52 O may be a split or antibacklash pulley (not shown) for taking up backlash in a known manner. The outboard pulley 52 O is reciprocally driven by a motor 58.

The print trolley 28 carries a double pinion or gear 44 mounted on center of rotation 36 with arm 30. The gear 44 rides in an antibacklash rack 46 of known design and drives a pulley 48 carried thereby. The transfer roll 18 carries a pulley 32' concentrically mounted at center of rotation 36 with gear 44 and arm 30. An idler pulley 34 is suitably mounted to the arm 30. A pair of timing belts 54, similar to timing belts 56 referred to above, are threaded over the pulleys 48, 32 and 34. One of the pulleys 48 or 34 may be a split or antibacklash pulley for taking up backlash in a known manner. The timing belts 54 and 56 may have gear-like protrusions on their inner sides (not shown) matching mating portions (also not shown) on pulleys 32, 34, 48, 52 I and 52 O. As the print trolley 28 reciprocates between the respective inboard and outboard positions PI and PO (relative to the center C of turret 12), the gear 44 engages the rack 46 causing the pulley 48 and belt 54 driven thereby to move in a precise manner. Because backlash is taken up in pulleys 52 I, 52 O, 48, 32 and 34 and rack 46 and gear 44, the circumferential position of the transfer roll 18 is fixed relative to the position of the print trolley 28, the gravure surface 16 and the collector 22. Therefore, each transfer roll 18 at each print station 11 may be accurately positioned in registration relative to each other.

The doctor assembly 20 is carried in an ink trolley 62. A hydraulic piston 66 (for amooth action) is coupled to the ink trolley 62 and reciprocally drives the same between respective inboard and outboard positions PI' and PO'. An actuator arm 77 is coupled to the support bar 74. A pneumatic piston 76, mounted on ink trolley 62, is coupled to actuator arm 77. When the piston 76 is extended, the actuator arm 77 is driven clockwise, and the support bar 74 is likewise rotated clockwise about axis 75, to thereby move the squeege 70 into spaced engagement with the gravure surface 16 to spread ink thereon in a uniform film. When the piston 76 is contracted, the actuator arm 77 is rotated counterclockwise and the support bar 74 rotates counterclockwise about axis 75. The squeege 70 thereupon pulls out of engagement with the gravure surface 16 and the doctor blade 72 engages therewith for scraping excess ink 19 therefrom. When the ink trolley 62 is moved from the outboard position PO' to the inboard position PI', the squeege 70 spreads the ink 19 upon the gravure surface 16. Likewise, when the ink trolley 62 is moved towards outboard position PO', the doctor blade 72 removes excess ink 19 from gravure surface 16, and leaves ink 19 in engravings 17.

In a preferred embodiment, motor 58 is actuated for driving the print trolley 28 between the outboard position PO and the inboard position PI. The transfer roll 18, at position (1), carried by print trolley 28, as hereinbefore described, is rolled (outboard to inboard or left to right) across the gravure surface 16 for picking up the ink 19 from engravings 17. The ink 19 freezes thereon and forms the film 19'. As the transfer roll 18 reaches the extreme right of the gravure surface 16, the doctor assembly 20 begins moving from the outboard position PO' to the inboard position PI' for spreading a fresh bead 21 of ink 19 onto the gravure surface 16 to recharge the same. As this is occuring, the transfer roll 18 continues moving from left to right into engagement with the collector 22, whereupon it deposits the film 19', formed from the ink 19, onto the collector 22 as shown. A portion P of the design D is thus formed on collector 22. As the transfer roll 18 reaches position (2), the pneumatic piston 40 is actuated for pulling the actuator arm 38 counterclockwise about support 36 for raising the arm 30. The transfer roll 18, carried by arm 30, is thereby raised into position (3). Thereafter, the motor 58 is reversed, whereupon the print trolley 28 is drawn to the left to outboard position PO, and the transfer roll 18 is moved to position (4).

By the time the transfer roll 18 has reached position (3), ink trolley 62 has reached its inboard position PI'. At such time, pneumatic piston 76 is contracted, pulling the actuator arm 77 counterclockwise, and thereby rotating the support bar 74. The squeege 70 is thus carried out of engagement with the gravure surface 16 and the doctor blade 72 is moved into engagement therewith. The pneumatic piston 66 is thereafter actuated to withdraw the ink trolley 62 to the outboard position PO' for doctoring the gravure surface 16 with blade 72. As the doctor assembly 20 is moved to the outboard position PO', the transfer roll 18 also moves from position (3) to (4). Once the doctor assembly 20 reaches outboard position PO', the transfer roll 13 may be moved from position (4) to position (1) for repeating the cycle.

The complete design D is deposited onto an upfacing design carrying side 81 of the collector 22 while it is deployed inboard of the peripheral edge 15. Thereafter, the turret 12 is rotated into the tip out station 6. The collector 22 is thereafter rotated about hinge 24 to the position shown in FIG. 3, outboard of the peripheral edge 15, with design carrying side 81 facing down. The collector 22 is then indexed into print transfer station 13.

At the print transfer station 13, the plunger 26 engages a rearward side 83 of the membrane 82 (opposite the design carrying side 81) and stretches the membrane 82 into engagement with ware (not shown). The design D on the downward facing, design carrying side 81 of the collector 22 is pressed against the ware and transfers thereto. The collector 22 is floatably or resiliently mounted, as hereinafter described, and moves with plunger 26.

The hinge 24 carrying collector 22 includes a resilient or floating support or pivot 96, mounted to the turret 12 by means of a pneumatic piston 98 and an extendable rod 100. When the plunger 26 engages collector 22, the piston 98 yields to the downward force of the plunger 26 and allows the collector 22 to move therewith in a floating arrangement. The hinge 24 also includes a pinion 92 mounted to pivot 96. An actuator rack 90 engages pinion 92 for rotating the same. The actuator rack 90 may be a portion of an pneumatic piston 94 which is actuated between a right hand position R′ (shown in phantom) and left hand position L′ (shown in solid line). The actuator rack 90 engages the pinion 92 and rotates the same about the pivot 96 as the pneumatic piston 94 expands and contracts.

Figure 3:
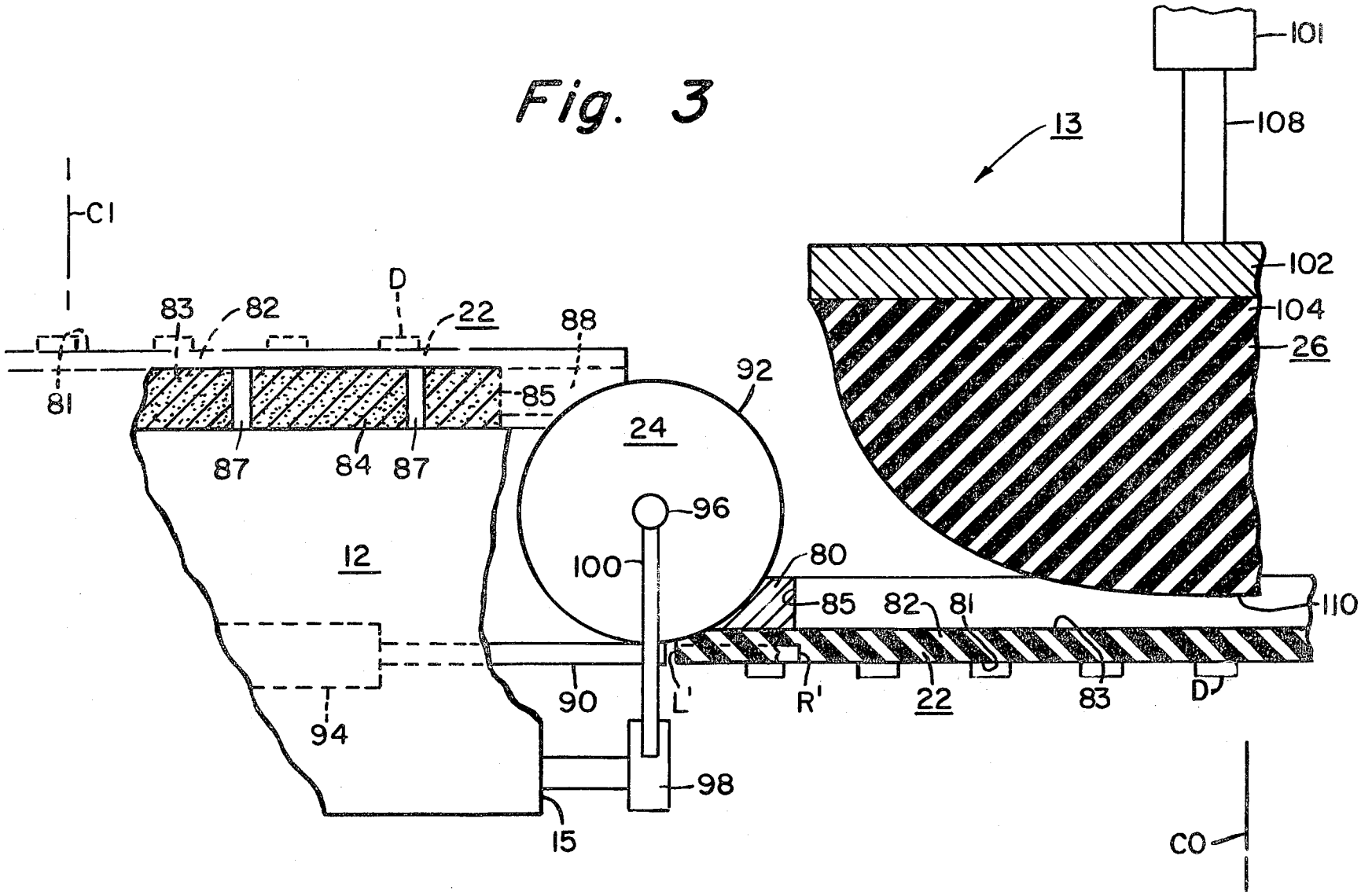
FIG. 3 is a fragmented schematic view of a print transfer station with a collector shown deployed in a print transfer position.

In FIG. 3, the collector 22 (shown in phantom) is deployed inboard of peripheral edge 15 of the turret 12 and centered at inboard circle CI. The collector 22 is mounted over a backing plate 84, such as an elastomeric sheet, having a plurality of holes 87 having a diameter of about 0.03″. The backing plate 84 has a durometer of between 30 and 90 points as measured on a Shore-OO hand held gauge, manufactured by Shore Instrument and Manufacturing Co. The backing plate 84 fits into an aperture 85 of frame 80 for engaging the backside 83 of the membrane 82. The backing plate 84 is coupled to a vacuum line (not shown) for drawing vacuum therethrough. When the collector 22 is located above the backing plate 84, the vacuum secures the membrane 82 in position for receiving the design D on the upward facing design carrying surface 81 thereof.

After the design D is deposited onto the collector 22, and the collector 22 is moved into the print transfer station 13, the pneumatic piston 94 is contracted for pulling the actuator rack 90 to the left position L′ and rotating the pinion 92 clockwise. The pinion 92, attached to the frame 80, rotates the collector 22 about the pivot 96 and into the outboard position, centered on outboard circle CO, (shown in solid line in FIG. 3). The design carrying surface 81 and design D are now facing downwardly.

The print transfer station 13, shown in FIG. 3, includes a plunger 26, formed of a support 102 and a flexible pad 104 carried thereby. The flexible pad 104 has a shaped face 110. The support 102 is coupled to a hydraulic piston 101 (for smooth action) by means of a piston rod 108. The hydraulic piston 101 moves the plunger 26 into and out of engagement with the collector 22. After the ware (not shown) is located below the collector 22, the hydraulic piston 101 is expanded for urging the plunger 26 against the backside 83 of the membrane 82, whereupon the membrane 82 conforms with the shaped face 110 of the plunger 26. The collector 22 moves with plunger 26 as hereinbefore noted. When the ware and the membrane 82 are engaged in intimate contact, the design D transfers from the design carrying side 81 of the membrane 82 to the ware. Thereafter, the plunger 26 is withdrawn allowing the collector 22 to be released from the ware. The collector 22 may be moved up by expansion of pneumatic piston 98 to evenly release collector 22 from the ware. Thereafter, the actuator rack 90 is moved to the right hand position R′ thereby turning the pinion 92 about pivot 96. The collector 22 is thus rotated about pivot 96 and deployed to the inboard position shown in phantom lines and centered at inboard circle CI. The pivot 96 may be adjustably positioned by means of the pneumatic piston 98 and rod 100 for pulling the collector frame 80 downwardly over the backing plate 84. Also the pneumatic piston 98 allows the collector 22 to move with the plunger 26 as the collector 22 is urged against the ware.

A control 60 shown in FIG. 2, such as a model 5T-1 programmable controller sold by Texas Instruments, may be used to operate the printing apparatus 10. The position and condition of various devices mentioned herein, including the transfer roll 18; doctor assembly 20; the pneumatic pistons 40, 76, 94, 98; the hydraulic pistons 66 and 101; the collector 22; print trolley 28; ink trolley 62; indexable drive 14; motor 58 and the like may be sensed by limit or proximity switches (not shown). Such devices are well known in the art. The control 60 may be operatively coupled to the aforementioned various devices, through various known pneumatic and electrical actuators (not shown), for controlling the same in accordance with the sequence and conditions noted above. The control scheme is known in the art and is not detailed herein.

For a more detailed description of a preferred flexible membrane collector and suitable inks, reference is directed to U.S. patent application Ser. Nos. 419,196 and 419,204, filed this same date, which are owned by the assignee of the present invention and which are incorporated herein by reference as may be necessary.

We claim:

1. A printing apparatus for decorating articles comprising:

a circular turret rotatable about its center, said turret having an outer peripheral edge;

a plurality of collectors mounted on said turret at arcuately spaced intervals and equally spaced from said center and lying in a plane; each collector including a frame having an aperture therein; and a membrane stretched across the frame over the aperture, the membrane having a design carrying side;

a plurality of print stations including a gravure surface having engravings thereon, the gravure surface forming a portion of a design; a squeege for spreading ink across the gravure surface; a doctor blade for doctoring the ink; a support bar mounted on an axis carrying the squeege and doctor blade in opposition about the axis; means coupled to the support bar for rotating the same about the axis for engaging the squeege with the gravure surface and rotating the support bar about the axis for withdrawing the squeege from the gravure surface and engaging the doctor blade therewith; means for reciprocally moving the support bar relative to the gravure surface when one of the squeege and the doctor blade is engaged with the gravure surface; a transfer roll adapted to be rolled in the plane across the gravure surface and the collector for picking up the ink from the gravure surface and depositing it on the collector; a print trolley reciprocally mounted between respective inboard and outboard positions and a pivotal support mounted thereon; a support arm mounted in said pivotal support, the transfer roll being rotatably mounted to said support arm and being carried about said pivotal support; pivoting means coupled to the support arm for actuating the same and moving the transfer roll tangentially into the plane at the outboard position and out of the plane at the inboard position; means for moving the trolley from the outboard to the inboard position for rollably engaging the transfer roll with the gravure surface and the collector while in the plane and for moving the transfer roll out of the plane while the trolley moves from the inboard to the outboard position; belt means responsive to the position of the trolley for rollably driving the transfer roll to thereby maintain the same in a repeatably registerable position relative to each collector;

print transfer means including a flexible plunger for engaging a side of the collector opposite the design carrying side thereof and driving the same into engagement with the articles to be decorated for transferring the complete design to the articles by intimate contact with the collector; means for rotatably indexing the turret so that each collector is sequentially aligned with each print station and the print transfer station in registration with a portion of the design produced at each other print station to thereby produce a complete design; hinge means coupling each collector to the turret near a peripheral edge thereof; and means for deploying the collector between the respective positions inboard and outboard of the peripheral edge of the turret, the design carrying side of the collector facing in one direction while receiving the design and in an opposite direction for engaging the articles to be decorated.

2. A printing apparatus as set forth in claim 1 wherein each print station further includes: an elastomeric backing member having a plurality of holes therein, the backing member for receiving therein the collector and for supporting the same and securing the collector by vacuum drawn through said holes.

3. The print apparatus as set forth in claim 2 wherein each hole is about 0.03" in diameter.

4. A printing apparatus as set forth in claim 2 wherein the backing member has a durometer of about 30 to 90 points as measured on a Shore-OO hand held gauge.

5. A printing apparatus as set forth in claim 1 further including: means for resiliently supporting the hinge relative to the object and including a pneumatic piston for urging collector in opposing directions when deployed to the respective inboard and outboard positions.

* * * * *